US005103241A

United States Patent [19]

Wu

[11] Patent Number: 5,103,241

[45] Date of Patent: Apr. 7, 1992

[54] HIGH Q BANDPASS STRUCTURE FOR THE SELECTIVE TRANSMISSION AND REFLECTION OF HIGH FREQUENCY RADIO SIGNALS

[75] Inventor: Te-Kao Wu, Rancho Palos Verdes, Calif.

[73] Assignee: Hughes Aircraft Company, Los Angeles, Calif.

[21] Appl. No.: 622,132

[22] Filed: Dec. 3, 1990

Related U.S. Application Data

[63] Continuation of Ser. No. 387,477, Jul. 28, 1989, abandoned.

[51] Int. Cl.[5] ..... H01Q 15/100; H01Q 1/420

[52] U.S. Cl. ..... 343/909; 343/872

[58] Field of Search ..... 343/872, 873, 909

[56] References Cited

U.S. PATENT DOCUMENTS

| | | | |
|---|---|---|---|
| 4,125,841 | 11/1978 | Munk | 343/909 |
| 4,314,255 | 2/1982 | Kornbau | 343/909 |
| 4,495,506 | 1/1985 | Sasser et al. | 343/909 |
| 4,517,571 | 5/1985 | Mulliner et al. | 343/771 |
| 4,701,765 | 10/1987 | Arduini et al. | 343/909 |

OTHER PUBLICATIONS

Luebbers et al., Cross Polar, Losses in Periodic Arrays of Loaded Slots, IEEE Trans. Ant & Prop. vol. AP 23 No. 2 1975 pp. 159–164.

Luebbers et al. Mode Matching Analysis of Biplanar Slot Arrays IEEE Trans. Ant. & Prop. vol. AP 27 No. 3, May 1979 pp. 441–443.

Chen, Diffraction of EMAG Waves by a Conducting Screen Perforated Periodically with Circular Holes, IEEE Tans. MWave Theory and Tech. MTT 19, No. 5, 1971, pp. 475–481.

Oh et al., A slotted Metal Radome Car for Rain Hail and Lightning Projection, Microwave Journal Mar. 1968 pp. 105–108.

*Primary Examiner*—Rolf Hille

*Assistant Examiner*—Peter Toby Brown

*Attorney, Agent, or Firm*—Leonard A. Alkov; Wanda K. Denson-Low

[57] ABSTRACT

A radome structure that provides for the transmission and reflection of high frequency radio signals. The structure includes first and second thin electrically conductive frequency selective surfaces. Each of the surfaces is provided with a multiplicity of apertures dimensioned and spaced as a function of the frequency of the radio frequency signals transmitted through the structure. A multi-layered dielectric panel secures the surfaces in spaced relationship therebetween. The apertures of one of the panel are disposed in registry with the apertures of the other panels. In a specific embodiment of the invention, the apertures are rectangular and are spaced at less than one-half wavelength increments both vertically and horizontally. The present invention is well suited for use with electronically steered array antennas and is also suitable for use as a sub-reflector of a multiple beam and frequency reflector antenna system.

5 Claims, 3 Drawing Sheets

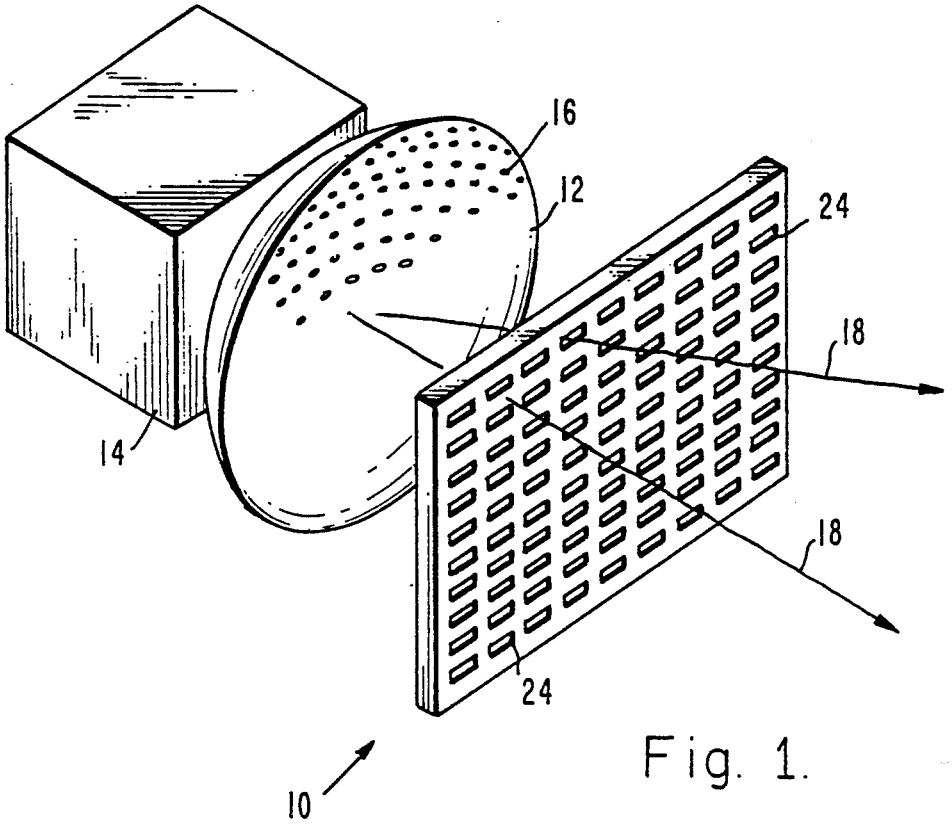
Fig. 1.
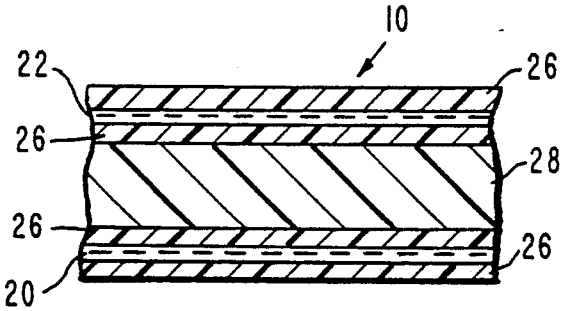
Fig. 3.
Fig. 2.
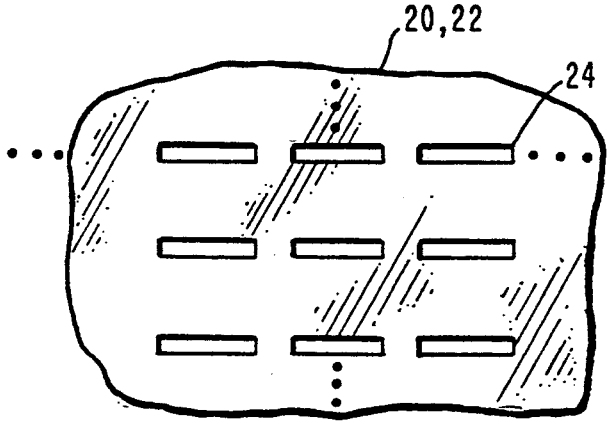

HIGH Q BANDPASS STRUCTURE FOR THE SELECTIVE TRANSMISSION AND REFLECTION OF HIGH FREQUENCY RADIO SIGNALS

This is a continuation of application Ser. No. 07/387,477 filed July 28, 1989 and now abandoned.

BACKGROUND

The present invention relates to structures such as a radome which transmit and reflect high frequency radio signals, and in particular to structures incorporating multi-layer slotted screens.

The basic function of a radome is to protect an antenna from environmental factors. The radome must typically protect an antenna while simultaneously the radome must not interfere with the electrical operation of a radar system. Radomes can range from simple plastic bubbles and air inflated enclosures for stationary systems, to structures which exhibit high structural strength and abrasion resistance in applications such as airborne radar systems. In the case of airborne systems, weight and structural strength become important factors and solutions to these requirements often result in degradation of the radar systems performance.

Conversely, a properly designed radome can enhance operation of a radar antenna in some respects. For example, a radome which exhibits a highly selective pass band and a high Q for the pass band will allow the radar system to operate effectively within its own operating bandwidth while simultaneously reflecting or rejecting other signals which lie outside the pass band of the system. This can be a very important factor in military applications where externally produced jamming signals and other friendly signals can degrade system performance.

One proposed solution for providing a radome structure which exhibits high transmission efficiency and a desirable pass band characteristic is a metallic screen having a multiplicity of slots therethrough. The screen is covered with, and the slots are filled with, a suitable dielectric material to fully close the structure and to control the electrical characteristics of slot configuration for transmission efficiency. A rigorous analysis of this structure is presented in a paper titled, "Transmission Through a Conducting Screen Perforated Periodically With Apertures" by Chao-Chun Chen published in *IEEE Transactions on Microwave Theory and Techniques*, Vol. MTT-18, 9, September 1970, page 627. This structure, while it exhibits some advantageous bandpass characteristics, also exhibits the undesirable characteristic of producing a frequency shift in a transmitted signal as a function of its angle of incidence on the radome structure.

In a subsequently proposed structure, the thin conductive screen analyzed by Chen was replaced with a thick conductive screen again perforated with periodically spaced apertures. The screen is enclosed in a dielectric sandwich with the dielectrics selected to modify the transmission characteristics of the structure. This structure is rigorously discussed and analyzed in the paper titled, "Some Effects of Dielectric Loading on Periodic Slot Arrays" by R. G. Lubbers, and B. A. Munk published in *IEEE Transactions on Antennas and Propagation*, Vol. AP-26, No. 4, July 1978, page 536. The thick screen is also analyzed in the paper entitled, "On The Theory And Solar Application of Inductive Grids", by R. C. McPhedran and D. Matystre published in *Applied Physics*, Vol. 14, January 1977, page 1. This structure exhibits an improved bandpass characteristic, and substantially reduced frequency shift degradation of a transmitted signal as a function of incident angle. However, due to the required thickness of the conductive screen, the structure is relatively heavy for airborne applications and the screen thickness presents significant manufacturing difficulties and expense.

It is therefore a feature of the present invention to provide a radome structure that exhibits a high Q bandpass characteristic which is light in weight, structurally sound, and economical to manufacture.

SUMMARY OF THE INVENTION

Broadly, the invention is a radome structure that provides for the transmission and reflection of a passband of high frequency radio signals. The radome includes first and second thin electrically conductive frequency selective surfaces. Each of the surfaces is provided with a multiplicity of apertures dimensioned and spaced as a function of the frequency or wavelength of the radio frequency signals transmitted through the radome. A multi-layered dielectric panel secures the surfaces and spaced relationship therebetween. The apertures of one of the panels are disposed in registry with the apertures of the other panel.

In a specific embodiment of the invention, the apertures are rectangular and are spaced at less than one-half wavelength of the center passband frequency increments both vertically and horizontally. Typically, the radome is planar. It is well suited for use with electronically steered array antennas. It should further be observed that while the invention is described as being applied to a radome structure, the structure is also suitable for use as a sub-reflector of a multiple beam and frequency reflector antenna system.

It is therefore an advantage of the invention to provide an improved structure for the frequency selective transmission of high frequency radio signals.

It is another advantage of the invention to provide a structure with a high Q bandpass characteristic that provides minimal frequency shift degradation of the transmitted signal as a function of transmission angle.

Still another advantage of the invention is to provide a structure which is structurally strong, light in weight, and economical to manufacture.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which:

FIG. 1 is a perspective drawing showing the radome structure of the present invention in association with a typical frequency swept electronically steered array antenna radar system;

FIG. 2 is a fragmentary plan view of the structure showing details of the apertures;

FIG. 3 is a fragmentary sectional view of the structure showing layers of the structure.

DETAILED DESCRIPTION

Figure 4:
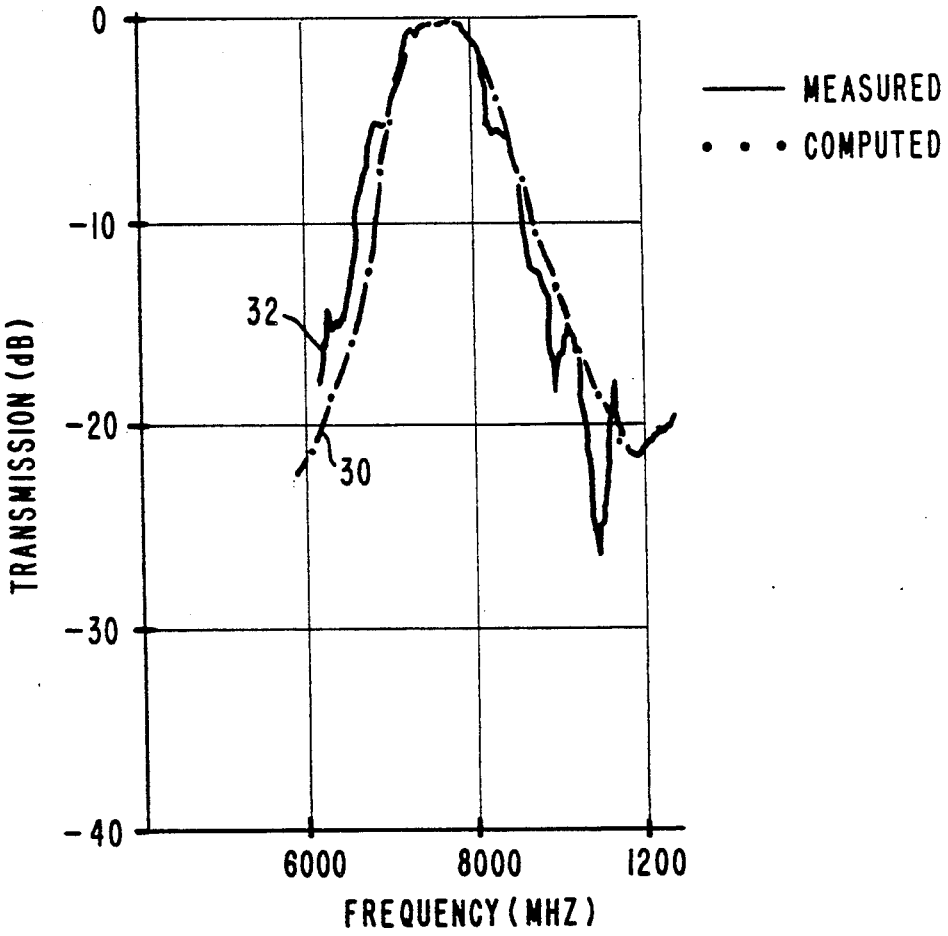
FIGS. 4, 5, and 6 are graphs showing the transmission characteristics provided by the structure of the invention.

Referring now to the drawings, FIG. 1 shows a radome 10 in accordance with the present invention that is positioned in front of an electronically steered array antenna 12 and a radar system indicated as box 14. It will be appreciated that in actual practice, the radome 10 is normally positioned in closer proximity to the array antenna 12 than is shown in FIG. 1. It will further be recognized by a person skilled in the art that high frequency radio signals radiated by the array antenna 12 are electronically steered by controlling the relative phase of the signals radiated by the individual elements 16 of the antenna 12, as indicated by ray lines 18.

Referring now to FIGS. 2 and 3, the radome 10 comprises a pair of generally planar conductive screens 20, 22 typically comprised of material such as copper having a thickness of about 0.0007 inches. Each of the screens 20, 22 is provided with a multiplicity of apertures 24 or slots. The apertures 24 are spaced both vertically and horizontally (as viewed in the drawings) as a periodic function of the wavelength of the high frequency radio signals transmitted by the radar system 14. Typically, the apertures are spaced less than ½ wavelength center-to-center spacings. In the illustrated embodiment, the apertures 24 have a vertical height of about 0.038 inches and a width of about 0.369 inches, with a center-to-center spacing of 0.499 inches. While the apertures 24 are shown as rectangular, it will be appreciated that these apertures 24 can be provided in other configurations such as circles or square loops or the like.

The screens 20, 22 are in turn sandwiched between dielectric members comprising a pair of Duroid 5870 laminates 26, for example, that have a dielectric constant $\epsilon=2.3$ and tan $\delta=0.003$ at X-band frequencies. The two Duroid laminates 26 and screens 20, 22 are secured together in parallel spaced relationship by means of a foam or similar dielectric spacer 28. The dielectric members may also be made of Emerson's Ecco Form dielectric material, or the like. In a working embodiment, the foam spacer 28 has a thickness of 0.125 inches, its dielectric constant $\epsilon=1.04$, and tan $\delta=0.001$ at X-band frequencies. The particular dimensions and dielectrics selected are calculated for use with a radar system center frequency of about 9.8 GHz.

Figure 5:
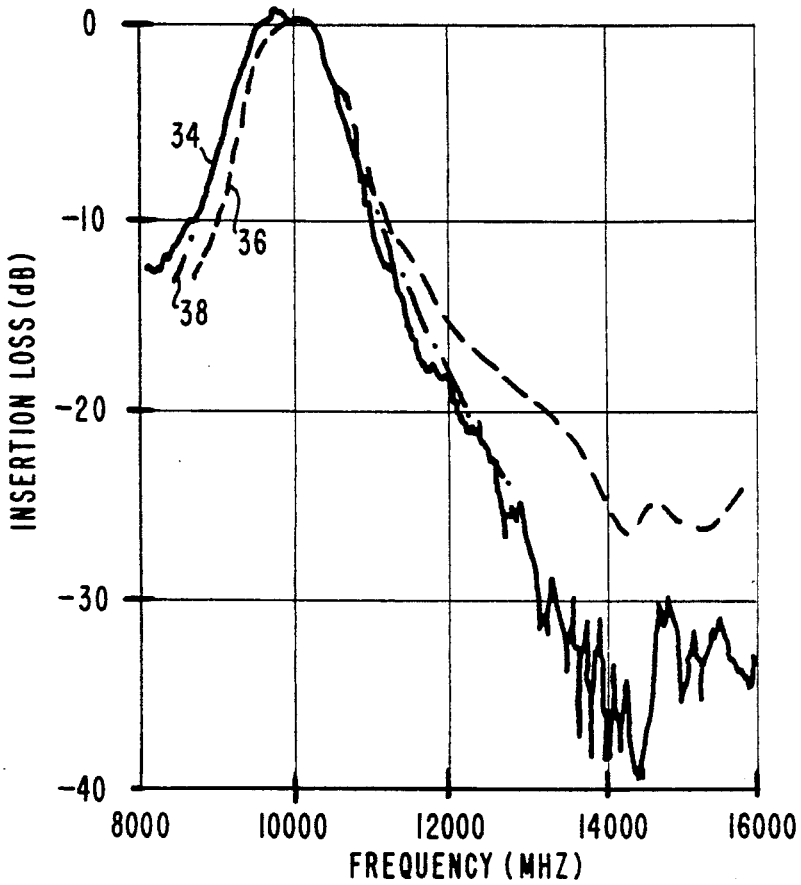
Figure 6:
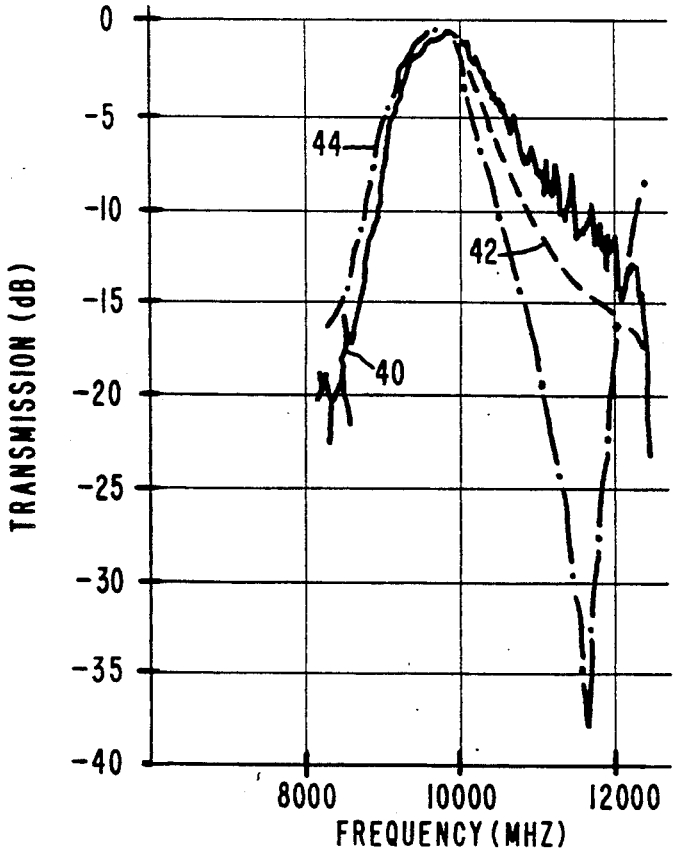

Referring now to FIGS. 4–6, the operating characteristics of the radome 10 are shown graphically. In FIG. 4, a graph line 30 shows the computed and anticipated performance of the radome 10. Overlying the graph line 30 is a graph 32 showing the actual characteristics of the radome 10 as measured in tests thereof. In this graph it will be seen that the radome 10 exhibits a highly peaked pass band that produces greater than 20 dB insertion loss to frequencies less than 0.85 $f_0$ or greater than 1.2 $f_0$, at an $f_0$ of 9.8 GHz. It will further be observed that the insertion loss at the selected operating frequency of 9.85 GHz is substantially zero. It will thus be recognized that the radome 10 provides both a very desirable peaked pass band and high Q transmission efficiency. These graphs were measured such that the angle of incidence of the transmitted signal was normal to the plane of the radome 10.

Referring now to FIG. 5, the measured transmission characteristics of the structure of the present invention in the H-plane is shown, with the angle of incidence at 15°, 30°, and 45°, for each of the graph lines 34, 36, and 38, respectively. Similarly, in FIG. 6, a graph is shown for the E-plane with transmission angles of 15°, 30°, and 45°, for each of the lines 40, 42, and 44 respectively. From these test results, it is seen that the radome 10 of the present invention also exhibits the desirable characteristic of having a minimally degrading effect on the transmitted signal over a wide range of incident angles. The bandwidth is, in fact, substantially constant for an incident angle steered from normal to 45°.

While the invention has been disclosed with a specific selection of dimension and materials, it will be appreciated that these dimensions and materials may be selected in accordance with well-known principles to adapt the structure for operating frequency ranges different from that of the disclosed specific embodiment. From the above description and discussion it will be apparent that the radome of the present invention provides a highly effective high Q bandpass radome structure. The structure is light in weight due to a light foam spacer and dielectrics in conjunction with very thin screens, is easily fabricated, and yet exhibits excellent structural strength due to the thickness of the multi-layered structure. While the structure has been specifically described in an application as a radome for an electronically steered array antenna, these same characteristics are suitable and beneficial for use in other applications, such as a sub-reflector of a multiple beam and frequency reflector antenna system, for example, where the bandpass and high Q characteristic of the structure are major considerations.

Thus there has been described a new and improved structure, such as a radome, that transmits and reflects high frequency radio signals, and which incorporates a multi-layer slotted screen that exhibits a high Q bandpass over a wide range of incident angles. It is to be understood that the above-described embodiment is merely illustrative of some of the many specific embodiments which represent applications of the principles of the present invention. Clearly, numerous and other arrangements can be readily devised by those skilled in the art without departing from the scope of the invention.

What is claimed is:

1. A radome that provides for the frequency selective tansmission and reflection of a passband of high frequency radio signals, said radome comprising:

first and second electrically conductive frequency selective surfaces, each of the conductive surfaces having a plurality of apertures therethrough having dimensions and being spaced as a function of the frequency of the radio frequency signal transmitted through the radome; and a multi-layered dielectric panel having a plurality of rigid dielectric layers enclosing each of the conductive surfaces, the dielectric panel securing the conductive surfaces in fixed spaced relationship with the apertures of one conductive surface in registry with the apertures of the other conductive frequency selective surface, the dielectric panel further including a central layer of low density dielectric material supporting the plurality of rigid dielectric layers in a position with the conductive surfaces spaced at a predetermined fraction of a wavelength of the radio frequency signal;

the first and second electrically conductive frequency selective surfaces comprising planar conductive screens respectively embedded in the plurality of rigid dielectric layers, each screen having a thickness on the order of 0.0007 inches and having generally rectangular slots therein;

the generally rectangular slots having dimensions of approximately 0.369 inches in length by 0.038 inches in width and having a periodicity of about 0.499 inches in both x and y directions;

the plurality of rigid dielectric layers having a dielectric constant $\epsilon$ of about 2.3 and tan $\delta$ of 0.003 at X-band frequencies;

the central layer of low density dielectric material having a thickness on the order of 0.125 inches with a dielectric constant $\epsilon$ of about 1.04 and tan $\delta$ of 0.001 at X-band frequencies;

the radome adapted to have a high Q at X-band frequencies, whereby at a center frequency of about 9.8 GHz, the radome is adapted to provide greater than 20 dB insertion loss for frequencies less than about 0.85 times the center frequency or greater than about 1.2 times the center frequency, while providing an approximately constant bandwidth as the incident angle is steered from normal to 45 degrees in the E and H plane.

2. The structure of claim 1 wherein the conductive frequency selective surfaces are thin in proportion to the wavelength of the radio frequency signals.

3. The structure of claim 2 wherein the length and width dimensions of said generally rectangular slots are a predetermined fraction of the wavelength of the center frequency of the radio frequency signal passband.

4. The structure of claim 3 having a generally planar configuration, and wherein the radio frequency signals are radar signals radiated from an electronically steered radar antenna.

5. The structure of claim 4 wherein the spacing between the conductive surfaces is less than $\frac{1}{2}$ wavelength of the center frequency.

* * * * *